US010403992B1

(12) United States Patent
Mason

(10) Patent No.: US 10,403,992 B1
(45) Date of Patent: Sep. 3, 2019

(54) SOCKET ASSEMBLY FOR AN ELECTRICAL SYSTEM

(71) Applicant: TE CONNECTIVITY CORPORATION, Berwyn, PA (US)

(72) Inventor: Jeffery Walter Mason, North Attleboro, MA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/941,689

(22) Filed: Mar. 30, 2018

(51) Int. Cl.

| | |
|---|---|
| ***H01R 12/00*** | (2006.01) |
| ***H01R 12/71*** | (2011.01) |
| ***H01R 13/41*** | (2006.01) |
| ***H01R 12/70*** | (2011.01) |
| ***H01R 13/24*** | (2006.01) |

(52) U.S. Cl.
CPC ..... *H01R 12/714* (2013.01); *H01R 12/7076* (2013.01); *H01R 13/2435* (2013.01); *H01R 13/2442* (2013.01); *H01R 13/41* (2013.01)

(58) Field of Classification Search
CPC ..... H01R 24/26; H01R 24/50
USPC ..... 439/66, 862
See application file for complete search history.

(56) References Cited

U.S. PATENT DOCUMENTS

| | | | | |
|---|---|---|---|---|
| 4,012,094 | A * | 3/1977 | VanRenssen | H01J 29/92 439/58 |
| 5,653,598 | A | 8/1997 | Grabbe | |
| 5,820,389 | A | 10/1998 | Hashiguchi | |
| 6,029,344 | A * | 2/2000 | Khandros | B23K 20/004 29/874 |
| 6,315,576 | B1 | 11/2001 | Neidich | |
| 6,916,186 | B2 | 7/2005 | Szu et al. | |
| 6,945,788 | B2 | 9/2005 | Trout et al. | |
| 7,258,550 | B2 * | 8/2007 | Chen | H01R 13/2435 439/66 |
| 9,017,115 | B2 * | 4/2015 | Connell | H01R 4/4809 439/862 |
| 9,425,525 | B2 | 8/2016 | Walden et al. | |
| 2005/0124183 | A1 | 6/2005 | Hou | |
| 2005/0174746 | A1 | 8/2005 | Hsiao et al. | |
| 2005/0239303 | A1 | 10/2005 | Lee et al. | |
| 2006/0024987 | A1 | 2/2006 | Huang et al. | |

* cited by examiner

*Primary Examiner* — Phuong K Dinh

(57) ABSTRACT

A socket assembly includes a socket substrate and socket contacts mounted to the socket substrate and extending through through holes of the socket substrate. Each socket contact includes a fixed end mounted to the socket substrate, a free end independently movable relative to the fixed end, a first mating beam, a second mating beam and a transition beam between the first mating beam and the second mating beam being a monolithic structure. The transition beam passes through the through hole and is flexible to allow relative flexing of the first mating beam and the second mating beam for compression of the socket contacts between an electronic package and a host circuit board.

20 Claims, 6 Drawing Sheets

SOCKET ASSEMBLY FOR AN ELECTRICAL SYSTEM

BACKGROUND OF THE INVENTION

The subject matter herein relates generally to a socket assembly for connecting an electronic package to a host circuit board of an electronic system.

The ongoing trend toward smaller, lighter, and higher performance electrical components and higher density electrical circuits has led to the development of surface mount technology in the design of printed circuit boards and electronic packages. Surface mountable packaging allows for a separable connection of an electronic package, such as an integrated circuit or a computer processor, to pads on the surface of the circuit board rather than by contacts or pins soldered in plated holes going through the circuit board. Surface mount technology may allow for an increased component density on a circuit board, thereby saving space on the circuit board.

One form of surface mount technology includes socket connectors. Conventional socket connectors include a substrate with terminals on one side of the substrate and an array of conductive solder elements, such as a ball grid array (BGA), on the opposite side, electrically connected through the substrate by conductive pathways through the substrate. The terminals engage contacts on the electronic package at a compressible interface. However, the solder elements are soldered to conductive pads on a host circuit board, such as a mother board. The solder elements create a permanent interface on the bottom side of the socket connector. Some known socket connectors have compressible interfaces on both the top side and the bottom side. For example, compressible terminals are provided on both the top side and the bottom side. However, such socket connectors typically utilize different terminals on both sides, increasing the number of parts and the assembly time thus increasing the manufacturing cost of the socket connector. Additionally, having two sets of terminals increases the thickness of the socket connector.

A need remains for a socket connector having improved mating with an electronic package and a host circuit board.

BRIEF DESCRIPTION OF THE INVENTION

In one embodiment, a socket assembly is provided for an electronic system including a socket substrate and socket contacts mounted to the socket substrate. The socket substrate includes an upper surface and a lower surface and having through holes. The socket contacts extend through corresponding through holes. Each socket contact includes a fixed end mounted to the socket substrate and a free end independently movable relative to the fixed end. Each socket contact includes a first mating beam, a second mating beam and a transition beam between the first mating beam and the second mating beam being a monolithic structure. The first mating beam is located above the upper surface for mating with the electronic package. The second mating beam is located below the lower surface for mating with the host circuit board. The transition beam passes through the through hole and is flexible to allow relative flexing of the first mating beam and the second mating beam for compression of the socket contacts between the electronic package and the host circuit board. One of the first mating beam or the second mating beam is located between the fixed end and the transition beam and the other of the first mating beam or the second mating beam is located between the free end and the transition beam.

In another embodiment, a socket assembly is provided for an electronic system including a socket substrate having an upper surface facing an electronic package and a lower surface facing a host circuit board. The socket substrate has a nonconductive substrate layer and a conductive substrate layer. The socket substrate has through holes extending through the nonconductive substrate layer and the conductive substrate layer. The socket assembly includes signal socket contacts each including a fixed end mounted to the nonconductive substrate layer of the socket substrate and a free end independently movable relative to the fixed end. Each signal socket contact includes a first mating beam, a second mating beam and a transition beam between the first mating beam and the second mating beam. The first mating beam, the second mating beam and the transition beam being a monolithic structure. The first mating beam is located above the upper surface for mating with the electronic package. The second mating beam is located below the lower surface for mating with the host circuit board. The transition beam passes through the corresponding through hole. The transition beam is flexible to allow relative flexing of the first mating beam and the second mating beam for compression of the signal socket contact between the electronic package and the host circuit board. The socket assembly includes ground socket contacts each including a fixed end mounted to the conductive substrate layer of the socket substrate and a free end independently movable relative to the fixed end. Each ground socket contact includes a first mating beam, a second mating beam and a transition beam between the first mating beam and the second mating beam. The first mating beam, the second mating beam and the transition beam are a monolithic structure. The first mating beam is located above the upper surface for mating with the electronic package. The second mating beam is located below the lower surface for mating with the host circuit board. The transition beam passes through the corresponding through hole. The transition beam is flexible to allow relative flexing of the first mating beam and the second mating beam for compression of the ground socket contact between the electronic package and the host circuit board. The conductive substrate layer electrically connects each of the ground socket contacts together.

In a further embodiment, an electronic system is provided including a host circuit board having host contacts, an electronic package having package contacts, and a socket assembly for electrically connecting the electronic package with the host circuit board. The socket assembly includes a socket substrate and socket contacts mounted to the socket substrate. The socket substrate has an upper surface facing an electronic package and a lower surface facing a host circuit board. The socket substrate has through holes. The socket contacts extend through corresponding through holes. Each socket contact includes a fixed end mounted to the socket substrate and a free end independently movable relative to the fixed end. Each socket contact includes a first mating beam, a second mating beam and a transition beam between the first mating beam and the second mating beam being a monolithic structure. The first mating beam is located above the upper surface for mating with the electronic package. The second mating beam is located below the lower surface for mating with the host circuit board. The transition beam passes through the through hole and is flexible to allow relative flexing of the first mating beam and the second mating beam for compression of the socket contacts between the electronic package and the host circuit board. One of the first mating beam or the second mating beam is located between the fixed end and the transition beam and the other of the first mating beam or the second mating beam is located between the free end and the transition beam.

DETAILED DESCRIPTION OF THE INVENTION

Figure 1:
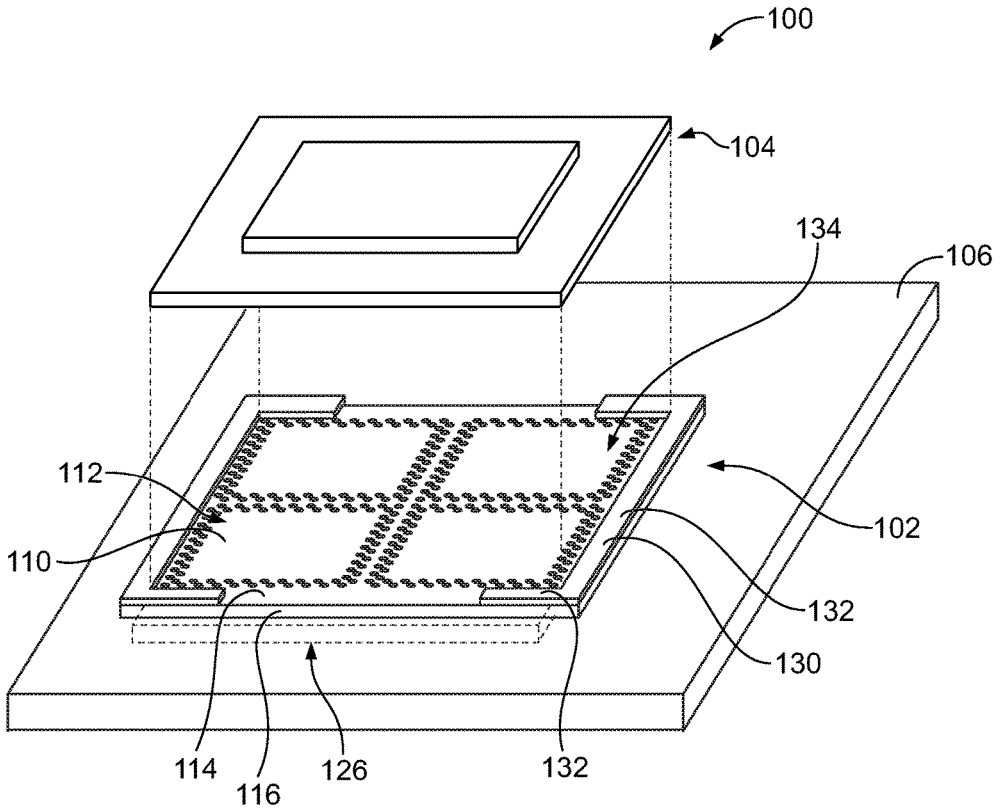
FIG. 1 is a perspective view of an electronic system in accordance with an exemplary embodiment.
Figure 2:
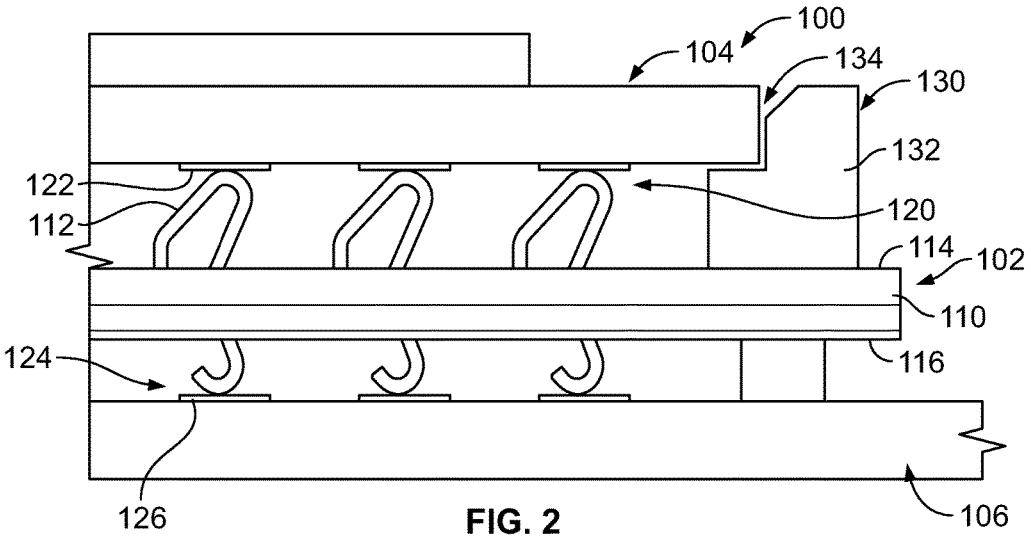
FIG. 2 is a side view of a portion of the electronic system showing a socket assembly formed in accordance with an exemplary embodiment.

FIG. 1 is a perspective view of an electronic system 100 in accordance with an exemplary embodiment. FIG. 2 is a side view of a portion of an electronic system 100 formed in accordance with an exemplary embodiment. The electronic system 100 includes a socket assembly 102 that receives an electronic package 104, such as an integrated circuit, a circuit board, and the like. In an exemplary embodiment, the socket assembly 102 is coupled to a host circuit board 106, such as a motherboard. The socket assembly 102 electrically connects the electronic package 104 with the host circuit board 106. In an exemplary embodiment, the socket assembly 102 is a dual compression socket assembly having an upper compressible mating interface for mating with the electronic package 104 and a lower compressible mating interface for mating with the host circuit board 106.

In an exemplary embodiment, the socket assembly 102 includes a socket substrate 110 having socket contacts 112 that define electrical paths between the electronic package 104 and the host circuit board 106. In an exemplary embodiment, the socket substrate 110 is a multi-layer substrate having an upper surface 114 and a lower surface 116. The socket substrate 110 may be rigid and provide a supporting structure for the socket contacts 112, such as to space the socket contacts 112 apart at predetermined locations for mating with the electronic package 104 and the host circuit board 106. The socket substrate 110 may be oriented generally parallel to the electronic package 104 and/or the host circuit board 106. In an exemplary embodiment, the socket contacts 112 define the electrical paths between the electronic package 104 and the host circuit board 106 and the electrical paths are not defined through circuits or conductors of the socket substrate 110. However, in alternative embodiments, the socket substrate 110 may be a printed circuit board having circuits or conductors, such as pads, traces (of or within the socket substrate 120), vias, and the like, that define electrical paths between the electronic package 104 and the host circuit board 106.

The socket contacts 112 may be arranged in an array defining an upper land grid array (LGA) interface 120 configured to mate to package contacts 122, such as contact pads of the electronic package 104, above the upper surface 114 of the socket substrate 110. The socket contacts 112 may be arranged in an array defining a lower LGA interface 124 configured to mate to host contacts 126, such as contact pads of the host circuit board 106, below the lower surface 116 of the socket substrate 110. The upper and lower LGA interfaces 120, 124 may be separable interfaces. The socket contacts 112 are compressible at the upper LGA interface 120. The socket contacts 112 are compressible at the lower LGA interface 124. In an exemplary embodiment, the socket contacts 112 are monolithic structures between the upper and lower LGA interfaces 120, 124. For example, one end of each socket contact 112 may be fixed to the socket substrate 110 and may be shaped to have two mating interfaces along the structure of the socket contact 112. For example, each socket contact 112 may be cantilevered from the fixed end extending to a free end, engaging both the package contact 122 and the host contact along the body of the socket contact 112. The socket contacts 112 are flexible and may be spring biased against the package contacts 122 and the host contacts 126 when compressed. Optionally, various socket contacts, such as ground contacts, may be electrically grounded and commoned to the socket substrate 110 while other socket contacts, such as signal contacts, may be electrically isolated form the socket substrate 110.

In an exemplary embodiment, the socket assembly 102 includes a socket frame 130 that supports components of the socket assembly 102. For example, the socket frame 130 may support the socket substrate 110. The socket frame 130 may support the electronic package 104. The socket frame 130 may be used to align the electronic package 104 with the upper LGA interface 120 for mating the electronic package 104 with the socket assembly 102. For example, frame walls 132 of the socket frame 130 may surround a socket opening 134 that receives the electronic package 104. The frame walls 132 may orient and align the electronic package 104 in one or more directions. In an exemplary embodiment, the socket frame 130 may limit or stop compression of the socket contacts 112 at the upper LGA interface 120 and/or the lower LGA interface 124 to prevent damage to the socket contacts 112, such as from overstress or plastic deformation. The socket frame 130 may be provided above and/or below the socket substrate 110.

In an exemplary embodiment, the electronic system 100 includes a heat sink (not shown) for dissipating heat from one or more of the components of the electronic system 100, such as from the electronic package 104 and/or the socket assembly 102 and/or the host circuit board 106. Optionally, the heat sink may be mounted to the host circuit board 106 and/or a mounting block (not shown) below the host circuit board 106. For example, the heat sink may be secured to the mounting block using fasteners. The heat sink, or another component, such as the socket frame 130, may provide a downward loading force on the electronic package and/or the socket substrate 110 to compress the socket contacts 112. For example, when the loading force is applied to the electronic package 104, the dual compressible LGA interfaces 120, 124 may be compressed forcing the socket contacts 112 into mated electrical contact with the package contacts 122 and the host contacts 126.

Figure 3:
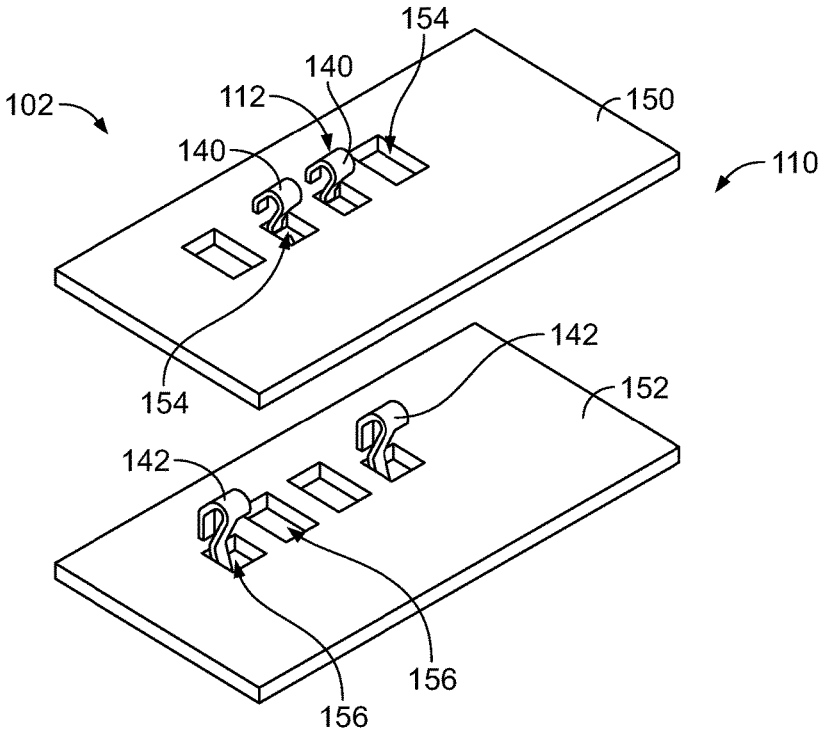
FIG. 3 is an exploded view of a portion of the socket assembly in accordance with an exemplary embodiment.

FIG. 3 is an exploded view of a portion of the socket assembly 102 in accordance with an exemplary embodiment. The socket assembly 102 includes the socket substrate 110 and a plurality of the socket contact 112. In an exemplary embodiment, the socket contacts 112 include signal socket contacts 140 and ground socket contacts 142. Other types of socket contacts may be provided in alternative embodiments, such as power socket contacts. The signal and ground socket contacts 140, 142 may be similar to each other. Like components of the signal socket contacts may be identified with like reference numerals with reference to the ground socket contacts 142, and vice versa.

The socket substrate 110 includes a nonconductive substrate layer 150 and a conductive substrate layer 152. The socket substrate 110 may include additional layers between the substrate layers 150, 152 and/or above the nonconductive substrate layer 150 and/or below the conductive substrate layer 152. The additional layers may be nonconductive substrate layers or conductive substrate layers. For example, FIG. 2 illustrates the socket substrate 110 with an additional nonconductive substrate layer below the conductive substrate layer 152. The conductive substrate layer 152 may be a metal layer, such as a copper layer, and aluminum layer or another metal layer. In an exemplary embodiment, the conductive substrate layer 152 defines a ground plane for the socket substrate 110 and each of the ground socket contacts 142 are electrically connected to the ground plane defined by the conductive substrate layer 152. In an exemplary embodiment, the signal socket contacts 140 are electrically isolated from the ground plane defined by the conductive substrate layer 152, such as by the nonconductive substrate layer 150. The nonconductive substrate layer 150 may be a plastic layer, such as a glass reinforced epoxy layer. The substrate layers 150, 152 may be laminated together. The substrate layers 150, 152 may be secured together using adhesive. The substrate layers 150 may be sheets, films, coatings or other types of layers.

In an exemplary embodiment, the nonconductive substrate layer 150 includes through holes 154 and the conductive substrate layer 152 includes through holes 156. The through holes 154, 156 are aligned with each other and allow the socket contacts 112 to pass through the socket substrate 110. For example, the signal socket contacts 140 pass through the through holes 154 in the nonconductive substrate layer 150 and pass through the through holes 156 in the conductive substrate layer 152. As such, the signal socket contacts 140 are configured to interface with the electronic package 104 above the socket substrate 110 and interface with the host circuit board 106 below the socket substrate 110. Similarly, the ground socket contacts 140 to pass through the through holes 156 in the conductive substrate layer 152 and pass through the through holes 154 and the nonconductive substrate layer 150. As such, the ground socket contacts 142 are configured to interface with the electronic package 104 above the socket substrate 110 and interface with the host circuit board 106 below the socket substrate 110.

In an exemplary embodiment, the signal socket contacts 140 are mounted to the nonconductive substrate layer 150. For example, the signal socket contacts 140 may be press-fit into the nonconductive substrate layer 150. The signal socket contacts 140 may be mechanically coupled to the nonconductive substrate layer 150 by other means in alternative embodiments. In alternative embodiments, the signal socket contacts 140 may be mechanically coupled to the conductive substrate layer 152 rather than the nonconductive substrate layer 150. In such embodiments, the nonconductive substrate layer 150 may be eliminated altogether. In such embodiments, the signal socket contacts 140 may be electrically isolated from the conductive substrate layer 152, such as using insulators therebetween.

In an exemplary embodiment, the ground socket contacts 142 are mounted to the conductive substrate layer 152. For example, the ground socket contacts 142 may be press-fit into the conductive substrate layer 152. In an exemplary embodiment, the ground socket contacts 142 are electrically connected to the conductive substrate layer 152 by the press-fit connection therebetween. The ground socket contacts 142 may be mechanically and electrically coupled to the conductive substrate layer 152 by other means in alternative embodiments. For example, the ground socket contacts 142 may be soldered to the conductive substrate layer 152. In alternative embodiments, the ground socket contacts 142 may be mechanically coupled to the nonconductive substrate layer 150 rather than the conductive substrate layer 152. In such embodiments, the conductive substrate layer 152 may be eliminated altogether.

Figure 4:
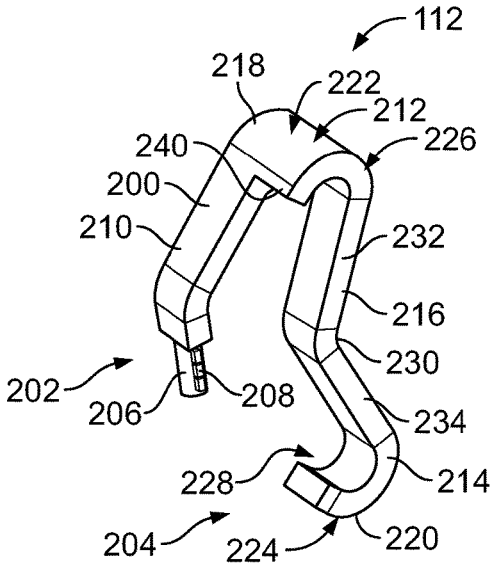
FIG. 4 is a perspective view of a socket contact of the socket assembly in accordance with an exemplary embodiment.
Figure 5:
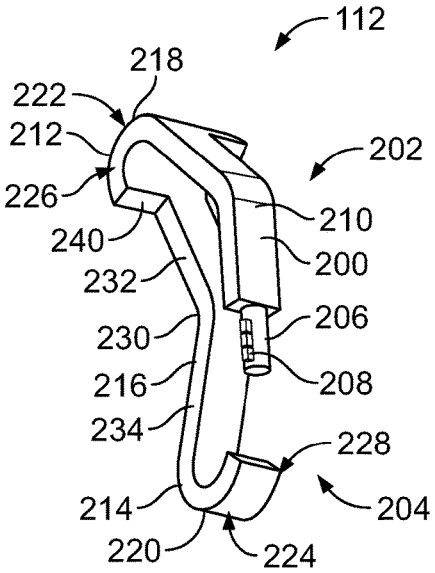
FIG. 5 is a perspective view of the socket contact in accordance with an exemplary embodiment.
Figure 6:
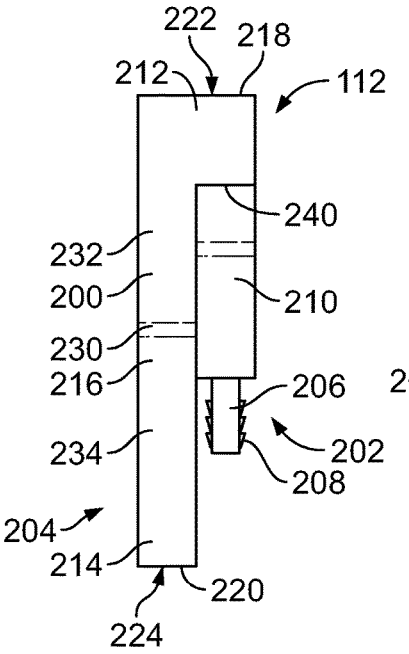
FIG. 6 is an end view of the socket contact in accordance with an exemplary embodiment.
Figure 7:
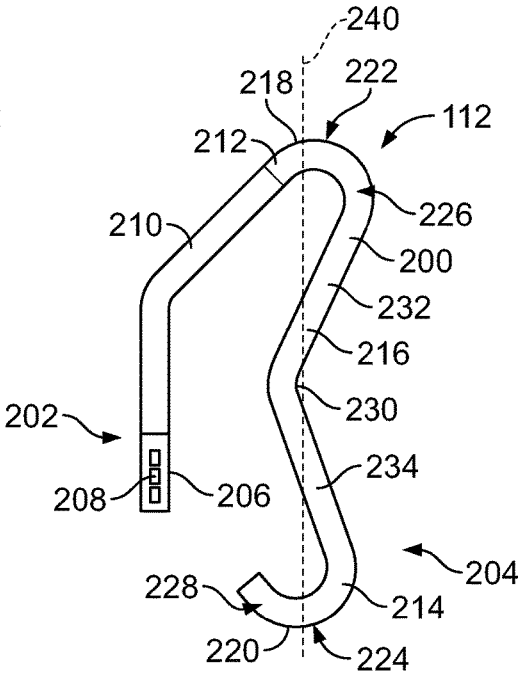
FIG. 7 is a side view of the socket contact in accordance with an exemplary embodiment.

FIG. 4 is a perspective view of the socket contact 112 in accordance with an exemplary embodiment. FIG. 5 is a perspective view of the socket contact 112 in accordance with an exemplary embodiment. FIG. 6 is an end view of the socket contact 112 in accordance with an exemplary embodiment. FIG. 7 is a side view of the socket contact 112 in accordance with an exemplary embodiment. The socket contact 112 may be the signal socket contact 140 (FIG. 3) or may be the ground socket contact 142 (FIG. 3).

The socket contact 112 includes a monolithic body 200 extending between a fixed end 202 and a free end 204. The socket contact 112 may be a stamped and formed contact where the body 200 is stamped from a sheet of metal and formed into a predetermined shape including the fixed end 202 and the free end 204. The fixed end 202 is configured to be coupled to the socket substrate 110 (shown in FIG. 3). The free end 204 is configured to be cantilevered from the socket substrate 110 at the fixed end 202. In the illustrated embodiment, the fixed end 202 is provided near a top of the socket contact 112 and the free end 204 is provided near a bottom of the socket contact 112. However, other orientations are possible in alternative embodiments. For example, the socket contact 112 may be coupled to the socket substrate 110 in the reverse orientation in alternative embodiments.

In an exemplary embodiment, the socket contact 112 includes a mounting beam 206 at the fixed end 202. The mounting beam 206 is used to mount the socket contact 112 to the socket substrate 110. In the illustrated embodiment, the mounting beam 206 is a press-fit beam configured to be press-fit into the socket substrate 110. The mounting beam 206 includes barbs 208 along the exterior of the mounting beam 206 to secure the mounting beam 206 in the socket substrate 110. Other types of mounting beams may be provided in alternative embodiments. For example, the mounting beam 206 may be a compliant beam, such as an eye-of-the-needle pin, configured to be press-fit into the socket substrate 110.

In an exemplary embodiment, the socket contact 112 includes a support beam 210 at the fixed end 202 extending from the mounting beam 206. The support beam 210 transitions away from the mounting beam 206 and the socket substrate 110. For example, the support beam 210 may extend upward and/or rearward to transition away from the mounting beam 206.

The socket contact 112 includes a first mating beam 212, a second mating beam 214 and a transition beam 216 between the first mating beam 212 and the second mating beam 214. The first mating beam 212, the second mating beam 214 and the transition beam 216 are a monolithic structure defining the monolithic body 200 with the support beam 210 and the mounting beam 206. The first mating beam 212, the second mating beam 214 and the transition beam 216 extend between a top 218 and a bottom 220 of the socket contact 112. In the illustrated embodiment, the first mating beam 212 is provided at the top 218 and defines a first or upper mating interface 222 and the second mating beam 214 is provided at the bottom 220 and defines a second or lower mating interface 224. The first mating beam 212 includes a first hook 226 defining the upper mating interface 222 and the second mating beam 214 includes a second hook 228 defining the lower mating interface 224. The body 200 changes direction at the first hook 226 and at the second hook 228. In the illustrated embodiment, the first mating beam 212 extends between the support beam 210 at the fixed end 202 and the transition beam 216 and the second mating beam 214 extends between the transition beam 216 and the free end 204. Other orientations are possible in alternative embodiments, such as with the second mating beam 214 extending from the support beam 210 at the fixed end 202.

The transition beam 216 includes a fold 230 with a first arm 232 above the fold 230 and a second arm 234 below the fold 230. The body 200 changes direction at the fold 230. The transition beam 216 is flexible to allow relative flexing of the first mating beam 212 and the second mating beam 214 for compression of the socket contact 112 between the electronic package 104 and the host circuit board 106. The transition beam 216 may be shortened when the socket contact 112 is compressed. For example, during compression, the first and second mating interfaces 222 may be moved closer together. The transition beam 216 is flexed at the fold 230 and the angle of the fold 230 may be reduced during compression. For example, the first arm 232 may be moved closer to the second arm 234. Additionally or alternatively, the shapes of the first and second hooks 226, 228 may change during compression of the socket contact 112. For example, the radius of curvature of the first hook 226 and/or the second hook 228 may be reduced during compression of the socket contact 112.

In an exemplary embodiment, the first mating beam 212 and the second mating beam 214 are aligned along a vertical mating axis 240. For example, the upper mating interface 222 and the lower mating interface 224 may be aligned along the vertical mating axis 240. In an exemplary embodiment, the mating axis 240 is offset from the fixed end 202, such as shifted rearward of the fixed end 202. As such, the fixed ends 202 may be coupled to the socket substrate 112 while the transition beam 216 is offset to pass through the through holes of the socket substrate 110.

In an exemplary embodiment, the body 200 of the socket contact 112 is a split beam design having the fixed end 202 laterally offset from the free end 204. For example, the support beam 210 and the mounting beam 206 at the fixed end 202 are laterally offset relative to the first mating beam 212, the second mating beam 214 and the transition beam 216 at the free end 204. The lateral offset allows the transition beam 216 to bypass the support beam 210 at the fixed end 202 when the socket contact 112 is compressed. The socket contact 112 includes an offset beam 242 laterally shifting the first mating beam 212, the second mating beam 214 and the transition beam 216 relative to the support beam 210 and the mounting beam 206.

Figure 8:
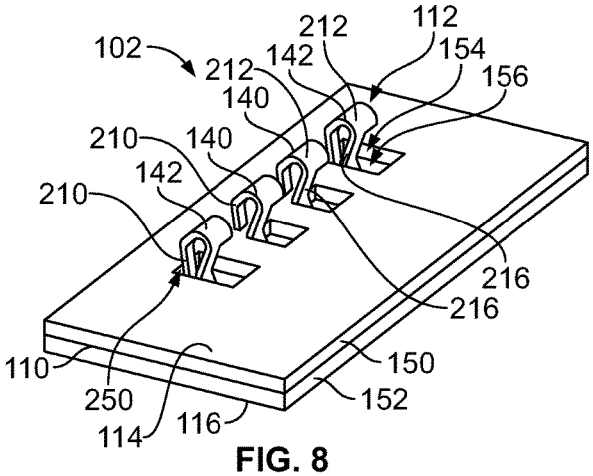
FIG. 8 is a perspective view of a portion of the socket assembly showing the socket contacts coupled to a socket substrate in accordance with an exemplary embodiment.
Figure 9:
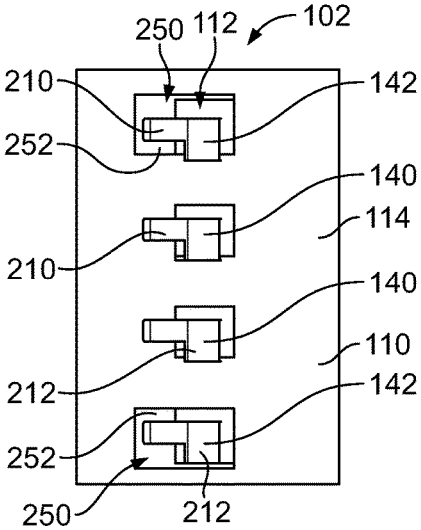
FIG. 9 is a top view of a portion of the socket assembly showing the socket contacts coupled to the socket substrate in accordance with an exemplary embodiment.

FIG. 8 is a perspective view of a portion of the socket assembly 102 showing the socket contacts 112 coupled to the socket substrate 110. FIG. 9 is a top view of a portion of the socket assembly 102 showing the socket contacts 112 coupled to the socket substrate 110. When assembled, the socket contacts 112 are supported by the socket substrate 110 and extend through corresponding through holes 154, 156 in the substrate layers 150, 152 of the socket substrate 110.

In an exemplary embodiment, the signal socket contacts 140 are mounted to the nonconductive substrate layer 150 and the ground socket contacts 142 are mounted to the conductive substrate layer 152. The nonconductive substrate layer 150 includes pockets 250 above mounting pads 252 of the conductive substrate layer 152 where the ground socket contacts 152 are mounted to the conductive substrate layer 152. The ground socket contacts 140 to pass through the pockets 250 for mounting to the conductive substrate layer 152. The mounting beams 206 (shown in FIG. 4) of the ground socket contacts 142 are press fit into the conductive substrate layer 152. Similarly, the mounting beams 206 (shown in FIG. 4) of the signal socket contacts 140 are press fit into the nonconductive substrate layer 150. The support beams 210 extend upward and rearward to align the transition beams 216 with the through holes 154, 156. The first mating beams 212 are located above the upper surface 114, the transition beams 216 pass through the corresponding through holes 154, 156, and a second mating beams 214 (shown in FIG. 4) are located below the lower surface 116.

Figure 10:
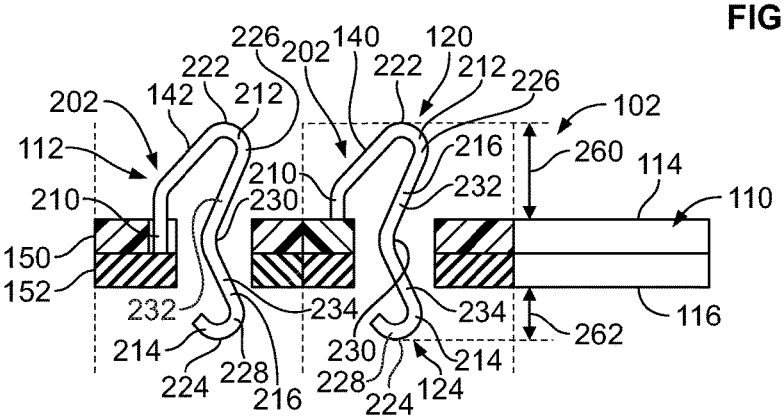
FIG. 10 is a partial sectional view of the socket assembly showing socket contacts in an uncompressed state in accordance with an exemplary embodiment.
Figure 11:
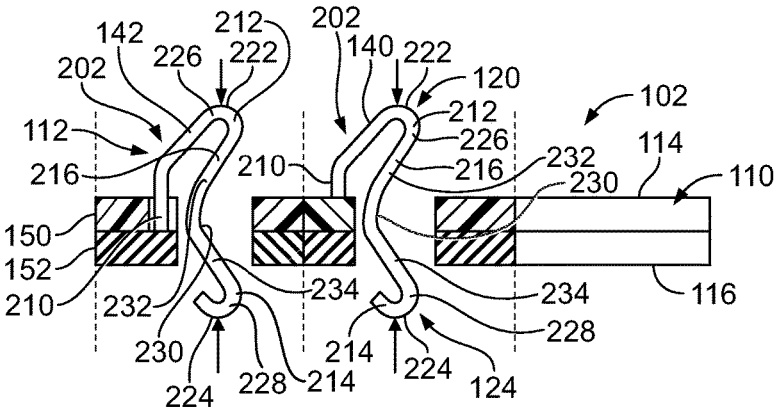
FIG. 11 is a partial sectional view of the socket assembly showing socket contacts in a compressed state in accordance with an exemplary embodiment.

FIG. 10 is a partial sectional view of the socket assembly 102 showing one of the signal socket contacts 140 and one of the ground socket contacts 142 in an uncompressed state. FIG. 11 is a partial sectional view of the socket assembly 102 showing one of the signal socket contacts 140 and one of the ground socket contacts 142 in a compressed state.

The signal socket contact 140 is mounted to the nonconductive substrate layer 150 and the ground socket contact 142 is mounted to the conductive substrate layer 152. The fixed ends 202 of the signal socket contacts 140 are configured to be coplanar at a first layer of the socket substrate 110, such as at the top of the nonconductive substrate layer 150. The fixed ends 202 of the ground socket contacts 142 are configured to be coplanar at a second layer of the socket substrate 110, such as at the top of the conductive substrate layer 152. The second layer is non-coplanar with the first layer, such as below the first layer. Optionally, the support beam 210 and/or the mounting beam 206 of the ground socket contact 142 is longer than the corresponding support beam 210 and/or mounting beam 206 of the signal socket contact 140 to allow mounting to the corresponding substrate layer 150 or 152. For example, because the ground socket contact 142 passes through the nonconductive substrate layer 150 to the conductive substrate layer 152, the support beam 210 of the ground socket contact 142 is longer than the support beam 210 of the signal socket contact 140.

The socket contacts 112 are coupled to the socket substrate 110 such that the first mating beam 212 is located above the upper surface 114 for mating with the electronic package 104 (shown in FIG. 2) and such that the second mating beam 214 is located below the lower surface 116 for mating with the host circuit board 106 (shown in FIG. 2). The first mating beam 212 may be positioned above the upper surface 114 a first distance 260 and the second mating beam 214 may be positioned below the lower surface 116 a second distance 262. Optionally, the first distance 260 may be approximately equal to the second distance 262. In an exemplary embodiment, the first mating beams 212 of the signal socket contacts 140 and the first mating beams 212 of the ground socket contacts 142 are coplanar for mating with the electronic package 104. For example, the support beams 210 are sized and shaped to position all of the first mating beams 212 of the signal socket contacts 140 and the ground socket contacts 142 coplanar at the upper LGA interface 120. The second mating beams 214 of the signal socket contacts 140 and the second mating beams 214 of the ground socket contacts 142 are coplanar for mating with the host circuit board 106. For example, the transition beams 216 are sized and shaped to position all of the second mating beams 214 of the signal socket contacts 140 and the ground socket contacts 142 coplanar at the lower LGA interface 124.

When the electronic package 104 is coupled to the socket assembly 102, the socket contacts 112 are compressed. The dual compressible LGA interfaces 120, 124 are compressed between the electronic package 104 and the host circuit board 106. When compressed, the upper and lower mating interfaces 222, 224 are brought closer together. When compressed, the transition beam 216 may be flexed and/or the first mating beam 212 may be flexed and/or the second mating beam 214 may be flexed. When compressed, the shape of the transition beam 216 may be changed, such as by changing the angle of the fold 230 and/or moving the first and second arms 232, 234 closer together. When compressed, the shape of the first mating beam 212 may be changed, such as by changing the shape of the first hook 226. For example, the first arm 232 may be moved closer to the support beam 210. When compressed, the shape of the second mating beam 214 may be changed, such as by changing the shape of the second hook 228. When compressed, the shape of the support beam 210 may be changed, such as by flexing the top of the support beam 210 toward the upper surface 114.

Figure 12:
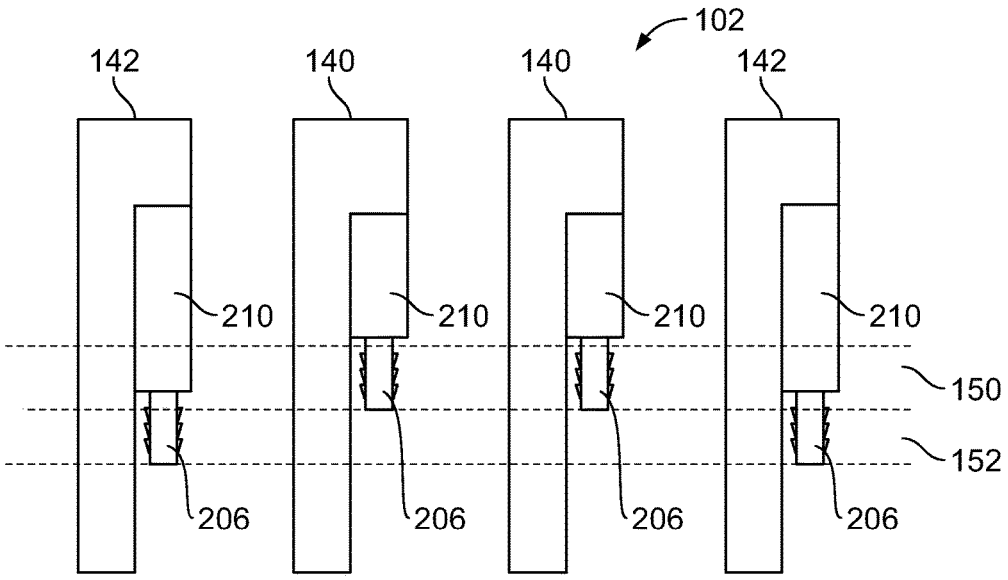
FIG. 12 is a partial view of the socket assembly showing socket contacts in accordance with an exemplary embodiment.

FIG. 12 is a partial view of the socket assembly 102 showing a pair of the signal socket contacts 140 and a pair of the ground socket contacts 142 flanking the signal socket contacts 140. Optionally, the signal socket contacts 140 may be provided in pairs and the ground socket contacts 142 may provide electrical shielding for the pairs of signal socket contacts 140. Any number and arrangement of signal socket contacts 140 and any number and arrangement of ground socket contacts 142 may be provided in various embodiments. FIG. 12 illustrates the ground signal contacts 142 having longer support beams 210 and the signal socket contacts 140 having shorter support beams 210 to position the mounting beams 206 of the signal socket contacts 140 at a different plane than the mounting beams 206 of the ground socket contacts 142. For example, the mounting beams 206 of the signal socket contacts 140 are configured to be received in the nonconductive substrate layer 150 and the mounting beams 206 of the ground socket contacts 142 are configured to be received in the conductive substrate layer 152 below the nonconductive substrate layer 150.

Figure 13:
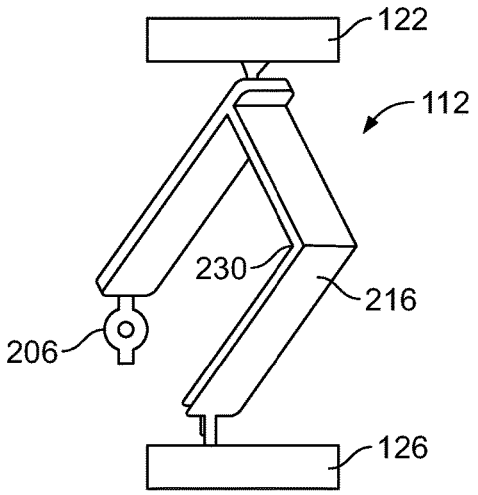
FIG. 13 illustrates the socket contact in accordance with an exemplary embodiment.

FIG. 13 illustrates the socket contact 112 in accordance with an exemplary embodiment. The socket contact 112 illustrated in FIG. 13 is similar to the socket contact 112 illustrated in FIG. 4; however, the transition beam 216 of the socket contact 112 illustrated in FIG. 13 extends rearward rather than forward. The fold 230 is reversed and bent in a different direction for compression of the socket contact 112 between the package contact 122 and the host contact 126. FIG. 13 illustrates the mounting beam 206 as a compliant pin, such as an eye-of-the-needle pin.

Figure 14:
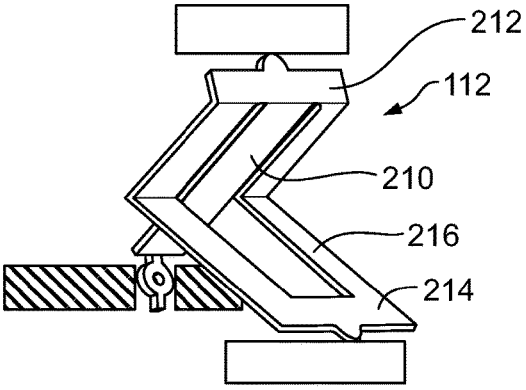
FIG. 14 illustrates the socket contact in accordance with an exemplary embodiment.

FIG. 14 illustrates the socket contact 112 in accordance with an exemplary embodiment. The socket contact 112 illustrated in FIG. 14 is similar to the socket contact 112 illustrated in FIG. 4; however, the transition beam 216 of the socket contact 112 illustrated in FIG. 14 is a double beam rather than a single beam between the first mating beam 212 and the second mating beam 214. The support beam 210 is centered in the gap between the double beam of the transition beam 216 to accommodate flexing of the transition beam 216 during compression.

Figure 15:
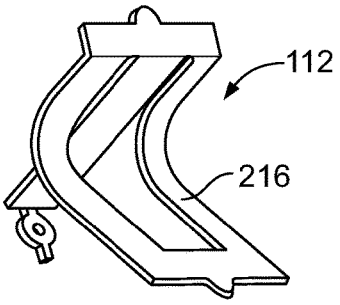
FIG. 15 illustrates the socket contact in accordance with an exemplary embodiment.

FIG. 15 illustrates the socket contact 112 in accordance with an exemplary embodiment. The socket contact 112 illustrated in FIG. 15 is similar to the socket contact 112 illustrated in FIG. 14; however, the transition beam 216 of the socket contact 112 illustrated in FIG. 15 is curved into a C-shape rather than a V-shape.

Figure 16:
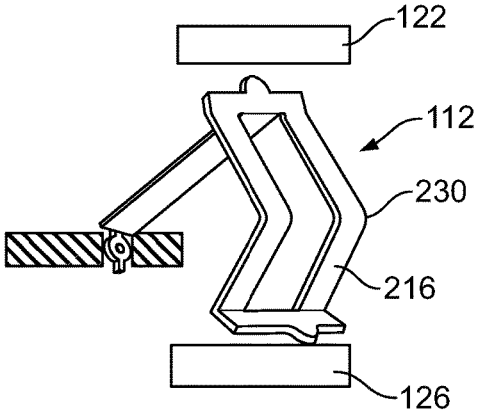
FIG. 16 illustrates the socket contact in accordance with an exemplary embodiment.

FIG. 16 illustrates the socket contact 112 in accordance with an exemplary embodiment. The socket contact 112 illustrated in FIG. 16 is similar to the socket contact 112 illustrated in FIG. 14; however, the transition beam 216 of the socket contact 112 illustrated in FIG. 16 extends rearward rather than forward. The fold 230 is reversed and bent in a different direction for compression of the socket contact 112 between the package contact 122 and the host contact 126.

Figure 17:
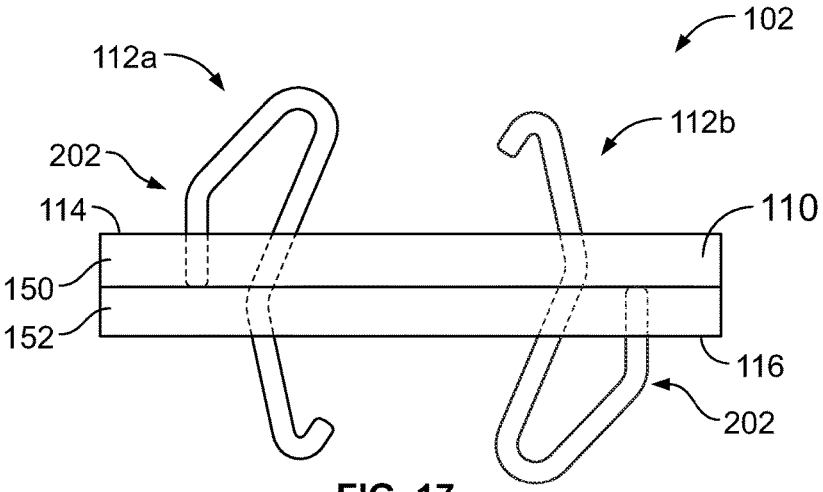
FIG. 17 is a partial sectional view of the socket assembly in accordance with an exemplary embodiment.

FIG. 17 is a partial sectional view of the socket assembly 102 in accordance with an exemplary embodiment. The socket assembly 102 illustrates a first socket contact 112*a* having the fixed end 202 at the upper surface 114 of the socket substrate 110 and a second socket contact 112*b* having the fixed ends 202 at the lower surface 116 of the socket substrate 110. The first socket contact 112*a* may be the signal socket contact 140 mounted to the nonconductive substrate layer 150 and the second socket contact 112*b* may be the ground socket contact 142 mounted to the conductive substrate layer 152.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A socket assembly for an electronic system comprising:

a socket substrate having an upper surface facing an electronic package and a lower surface facing a host circuit board, the socket substrate having through holes;

socket contacts mounted to the socket substrate and extending through corresponding through holes, each socket contact including a fixed end mounted to the socket substrate and a free end independently movable relative to the fixed end, each socket contact including a first mating beam, a second mating beam and a transition beam between the first mating beam and the second mating beam, the first mating beam, the second mating beam and the transition beam being a monolithic structure, the first mating beam being located above the upper surface for mating with the electronic package, the second mating beam being located below the lower surface for mating with the host circuit board, the transition beam passing through the through hole, the transition beam being flexible to allow relative flexing of the first mating beam and the second mating beam for compression of the socket contacts between the electronic package and the host circuit board, wherein one of the first mating beam or the second mating beam is located between the fixed end and the transition beam and the other of the first mating beam or the second mating beam is located between the free end and the transition beam.

2. The socket assembly of claim 1, wherein the first mating beam includes a first mating interface configured to engage a package contact of the electronic package and the second mating beam includes a second mating interface configured to engage a host contact of the host circuit board.

3. The socket assembly of claim 1, wherein the socket contact is cantilevered from the socket substrate at the fixed end.

4. The socket assembly of claim 1, wherein the first mating beam and the second mating beam are aligned along a vertical mating axis, the vertical mating axis being offset from the fixed end.

5. The socket assembly of claim 1, wherein the transition beam is shortened when the socket contact is compressed.

6. The socket assembly of claim 1, wherein the transition beam includes a fold, the transition beam flexing at the fold for compression of the socket contact.

7. The socket assembly of claim 1, wherein the first mating beam extends above the upper surface a first distance and the second mating beam extends below the lower surface a second distance, the first distance being approximately equal to the second distance.

8. The socket assembly of claim 1, wherein the first mating beams extend from the fixed ends of each of the socket contacts.

9. The socket assembly of claim 1, wherein the first mating beams of a first set of the socket contacts extend from the fixed ends and wherein the second mating beams of a second set of the socket contacts extend from the fixed ends.

10. The socket assembly of claim 1, wherein the socket substrate includes a nonconductive substrate layer and a conductive substrate layer, a first set of the socket contacts being mounted to the nonconductive substrate layer and a second set of the socket contacts being mounted to the conductive substrate layer.

11. The socket assembly of claim 1, wherein the socket contacts comprise signal socket contacts and ground socket contacts, each of the ground socket contacts being electrically connected to a conductive substrate layer of the socket substrate, each of the signal socket contacts being electrically isolated from the conductive substrate layer.

12. The socket assembly of claim 11, wherein the signal socket contacts are mounted to a nonconductive substrate layer of the socket substrate.

13. The socket assembly of claim 11, further comprising insulators at the fixed ends of the signal socket contacts, the insulators electrically isolating the signal socket contacts from the conductive substrate layer.

14. The socket assembly of claim 1, wherein the fixed end comprises a press-fit pin press-fit in the socket substrate to mechanically secure the socket contact to the socket substrate.

15. The socket assembly of claim 1, wherein the fixed end is laterally offset from the free end to allow the transition beam to bypass the fixed end when the socket contact is compressed.

16. The socket assembly of claim 1, wherein the socket contacts comprise signal socket contacts and ground socket contacts, the fixed ends of the signal socket contacts being coplanar at a first layer of the socket substrate, the fixed ends of the ground socket contacts being coplanar at a second layer of the socket substrate non-coplanar with the first layer, the first mating beams of the signal socket contacts and the first mating beams of the ground socket contacts being coplanar for mating with the electronic package, the second mating beams of the signal socket contacts and the second mating beams of the ground socket contacts being coplanar for mating with the host circuit board.

17. A socket assembly for an electronic system comprising:

a socket substrate having an upper surface facing an electronic package and a lower surface facing a host circuit board, the socket substrate having a nonconductive substrate layer and a conductive substrate layer, the socket substrate having through holes extending through the nonconductive substrate layer and the conductive substrate layer;

signal socket contacts each including a fixed end mounted to the nonconductive substrate layer of the socket substrate and a free end independently movable relative to the fixed end, each signal socket contact including a first mating beam, a second mating beam and a transition beam between the first mating beam and the second mating beam, the first mating beam, the second mating beam and the transition beam being a monolithic structure, the first mating beam being located above the upper surface for mating with the electronic package, the second mating beam being located below the lower surface for mating with the host circuit board, the transition beam passing through the corresponding through hole, the transition beam being flexible to allow relative flexing of the first mating beam and the second mating beam for compression of the signal socket contact between the electronic package and the host circuit board; and ground socket contacts each including a fixed end mounted to the conductive substrate layer of the socket substrate and a free end independently movable relative to the fixed end, each ground socket contact including a first mating beam, a second mating beam and a transition beam between the first mating beam and the second mating beam, the first mating beam, the second mating beam and the transition beam being a monolithic structure, the first mating beam being located above the upper surface for mating with the electronic package, the second mating beam being located below the lower surface for mating with the host circuit board, the transition beam passing through the corresponding through hole, the transition beam being flexible to allow relative flexing of the first mating beam and the second mating beam for compression of the ground socket contact between the electronic package and the host circuit board;

wherein the conductive substrate layer electrically connects each of the ground socket contacts together.

18. The socket assembly of claim 17, wherein the socket contact is cantilevered from the socket substrate at the fixed end.

19. The socket assembly of claim 17, wherein the socket contacts comprise signal socket contacts and ground socket contacts, the fixed ends of the signal socket contacts being coplanar at a first layer of the socket substrate, the fixed ends of the ground socket contacts being coplanar at a second layer of the socket substrate non-coplanar with the first layer, the first mating beams of the signal socket contacts and the first mating beams of the ground socket contacts being coplanar for mating with the electronic package, the second mating beams of the signal socket contacts and the second mating beams of the ground socket contacts being coplanar for mating with the host circuit board.

20. An electronic system comprising:

a host circuit board having host contacts;

an electronic package having package contacts; and a socket assembly for electrically connecting the electronic package with the host circuit board, the socket assembly comprising a socket substrate and socket contacts mounted to the socket substrate, the socket substrate having an upper surface facing an electronic package and a lower surface facing a host circuit board, the socket substrate having through holes;

socket contacts mounted to the socket substrate and extending through corresponding through holes, each socket contact including a fixed end mounted to the socket substrate and a free end independently movable relative to the fixed end, each socket contact including a first mating beam, a second mating beam and a transition beam between the first mating beam and the second mating beam, the first mating beam, the second mating beam and the transition beam being a monolithic structure, the first mating beam being located above the upper surface for mating with the electronic package, the second mating beam being located below the lower surface for mating with the host circuit board, the transition beam passing through the through hole, the transition beam being flexible to allow relative flexing of the first mating beam and the second mating beam for compression of the socket contacts between the electronic package and the host circuit board, wherein one of the first mating beam or the second mating beam is located between the fixed end and the transition beam and the other of the first mating beam or the second mating beam is located between the free end and the transition beam.

* * * * *